US008302267B2

(12) United States Patent
Morikawa et al.

(10) Patent No.: US 8,302,267 B2
(45) Date of Patent: Nov. 6, 2012

(54) LOAD FIXING DEVICE

(75) Inventors: Kahoru Morikawa, Osaka (JP); Takahide Yusuki, Osaka (JP); Katsuaki Sawachi, Osaka (JP)

(73) Assignee: Ecobiz Co., Ltd., Osaka (JP)

( * ) Notice: Subject to any disclaimer, the term of this patent is extended or adjusted under 35 U.S.C. 154(b) by 381 days.

(21) Appl. No.: 12/447,974

(22) PCT Filed: Nov. 9, 2007

(86) PCT No.: PCT/JP2007/071786

§ 371 (c)(1),
(2), (4) Date: Apr. 30, 2009

(87) PCT Pub. No.: WO2008/059762

PCT Pub. Date: May 22, 2008

(65) Prior Publication Data

US 2010/0071316 A1 Mar. 25, 2010

(30) Foreign Application Priority Data

Nov. 14, 2006 (JP) ..... 2006-307863
Jul. 10, 2007 (JP) ..... 2007-180810

(51) Int. Cl.
*B65B 11/02* (2006.01)

(52) U.S. Cl. ..... 24/302; 24/300; 24/301; 53/219; 53/399; 206/597; 410/97

(58) Field of Classification Search ..... 24/302, 24/300, 301; 53/219, 399; 206/597; 410/97
See application file for complete search history.

(56) References Cited

U.S. PATENT DOCUMENTS 3,371,815 A 3/1968 Macomber
4,868,955 A 9/1989 Magnant et al.
(Continued)

FOREIGN PATENT DOCUMENTS

DE 197 58 194 A1 5/1999
GB 2365402 2/2002
JP 2001-122322 5/2001
(Continued)

OTHER PUBLICATIONS

International Search Report for corresponding application No. PCT/2007/071786 completed Feb. 4, 2008.

*Primary Examiner* — Robert J Sandy
*Assistant Examiner* — David Upchurch
(74) *Attorney, Agent, or Firm* — Renner, Otto, Boisselle & Sklar, LLP

(57) ABSTRACT

There is provided a load fixing device capable of effectively preventing collapse of burdens stacked in multiple stages by wrapping with a sheet, providing excellent work efficiency, providing large binding force, and excellently stabilizing the fastened burdens.

A load fixing device according to the present invention includes a belt-like sheet having a predetermined length to be wounded around an outer periphery of loads; a first fastening section provided at an upper part in a width direction of a first end of the belt-like sheet and having an engagement means; a first-fastening-section passing section provided at the upper part in the width direction of a second end of the belt-like sheet; a second fastening section provided at a lower part in the width direction of the second end of the belt-like sheet and having an engagement means; and a second-fastening-section passing section provided at the lower part in the width direction of the first end of the belt-like sheet.

9 Claims, 8 Drawing Sheets

U.S. PATENT DOCUMENTS

| | | | | | |
|---|---|---|---|---|---|
| 4,876,841 | A | * | 10/1989 | Jensen | 53/399 |
| 5,006,385 | A | * | 4/1991 | Cheung et al. | 428/57 |
| 5,226,544 | A | * | 7/1993 | Gallucci et al. | 206/597 |
| 6,099,221 | A | | 8/2000 | Takagi | |

FOREIGN PATENT DOCUMENTS

| | | | |
|---|---|---|---|
| JP | 2003-054625 | | 2/2003 |
| JP | 2004-189292 | A | 7/2004 |
| WO | 2007/017964 | A1 | 2/2007 |

* cited by examiner

LOAD FIXING DEVICE

TECHNICAL FIELD

The present invention relates to a load fixing device. More specifically, the present invention relates to a load fixing device capable of effectively preventing collapse of burdens stacked in multiple stages by wrapping with a sheet, providing excellent work efficiency, providing large binding force, and excellently stabilizing the fastened burdens.

BACKGROUND ART

Generally, the burdens are conveyed by being stacked in multiple stages on a cargo pallet or carrier to enhance workability and save a storage area. In this case, unless collapse of burdens is prevented with some kind of method, a conveying task is interrupted when the burdens collapse, whereby the work efficiency significantly lowers and products are damaged. In order to prevent collapse of burdens, a method of conveying the burdens stacked on the pallet by wrapping with a stretch film, and thereafter, stripping the stretch film and unloading the burdens from the pallet is known.

However, in the method of preventing collapse of burdens using the stretch film, the stripped stretch film cannot be reused, which leads to waste of cost and resource. Further, because a discarded stretch film accumulates without being decomposed, a number of discarding places are required, which arises a problem of industrial waste. When burning the stretch film, gas and the like in time of burning may adversely affect a human body, which arises problems in terms of health and environment. Moreover, the burning of stretch films goes against the stream of the times whereas the discharge regulation of carbon dioxide is being demanded worldwide. In addition, when using the stretch film, the stretch film needs to be wounded and fixed while being wrapped around a periphery of the burdens over multiple times, which is an extremely troublesome work.

In order to solve such problems, numerous belt-like load fixing devices have been proposed. Patent Document 1 describes a belt for preventing collapse of burdens by being wrapped around an outer peripheral surface of the burdens stacked on the pallet. Such a burden-collapse preventing belt includes a belt body, a through ring (belt passing portion) attached to a proximal end side of the belt body, and a hook-and-loop fastener (male) and a hook-and-loop fastener (female) attached on one surface side of the belt body from a pull-out end towards the middle thereof. Such a burden-collapse preventing belt holds the outer peripheral surface of the burdens by passing the pull-out end through the through ring, pulling in the pull-out end, and then turning back the same to engage the male and the female of the hook-and-loop fasteners with each other. However, such a burden-collapse preventing belt has a narrow width, and thus cannot prevent collapse of burdens stacked in multiple stages. Therefore, multiple belts needs to be separately wrapped around the burdens.

Patent Document 2 describes a burden-collapse preventing fastening device (belt or sheet) having a wide width. According to such a fastening device, the burdens stacked in multiple stages can be wrapped with a sheet to prevent collapse of burdens. However, the binding force is insufficient in such a fastening device, and thus there is a problem in that the stability of the fastened burdens is insufficient.

Patent Document 1: JP 2001-122322 A

Patent Document 2: JP 2003-54625 A

DISCLOSURE OF THE INVENTION

The Problem to be Solved by the Invention

The present invention has been made in order to solve the above-mentioned problems and it is therefore an object to provide a load fixing device capable of effectively preventing collapse of burdens stacked in multiple stages by wrapping with a sheet, providing excellent work efficiency, providing large binding force, and excellently stabilizing the fastened burdens.

Means for Solving the Problem

A load fixing device according to the present invention includes a belt-like sheet having a predetermined length to be wounded around an outer periphery of loads; a first fastening section provided at an upper part in a width direction of a first end of the belt-like sheet and having an engagement means; a first-fastening-section passing section provided at the upper part in the width direction of a second end of the belt-like sheet; a second fastening section provided at a lower part in the width direction of the second end of the belt-like sheet and having an engagement means; and a second-fastening-section passing section provided at the lower part in the width direction of the first end of the belt-like sheet.

In a preferred embodiment, the belt-like sheet is made of recycled polyethylene terephthalate fiber. In a preferred embodiment, the engagement means are respectively at least one selected from a hook-and-loop fastener, a hook, a button, and a snap. In a preferred embodiment, the load fixing device further includes a temporary stopper provided at a predetermined position in a longitudinal direction of the belt-like sheet.

In a preferred embodiment, the first fastening section and the second fastening section are respectively removable with respect to the belt-like sheet. In a preferred embodiment, the first-fastening-section passing section and the second-fastening-section passing section are respectively a through-hole defined by the end of the belt-like sheet and a rod internally held at the end, or a ring member removable with respect to the belt-like sheet. In a further preferred embodiment, the rod internally held at the end is removable. In a preferred embodiment, the load fixing device further includes an upper fixing member to be engaged to the belt-like sheet. In a preferred embodiment, the load fixing device further includes an accommodation binding member.

Effects of the Invention

According to the present invention, the burdens can be fastened with a very strong binding force because the binding force is evenly exerted to the upper half and the lower half of the belt-like sheet by providing two fastening sections at the opposing corners of the belt-like sheet. Further, because the binding force is exerted in opposite directions at the upper half and the lower half of the belt-like sheet, excellent stability is obtained even if the burdens swing during transportation, and the probability of collapse of burdens is greatly reduced. In addition, the burdens can be satisfactorily fixed even by workers having a relatively weak strength such as women and elderly.

BRIEF DESCRIPTION OF THE DRAWINGS

[FIG. 1Aa] A plan view of main parts illustrating a front surface of a load fixing device according to another preferred embodiment of the present invention.

[FIG. 1Ab] A plan view of main parts illustrating a front surface of a load fixing device according to another preferred embodiment of the present invention.

DESCRIPTION OF THE REFERENCE NUMERALS

Figure 1A:
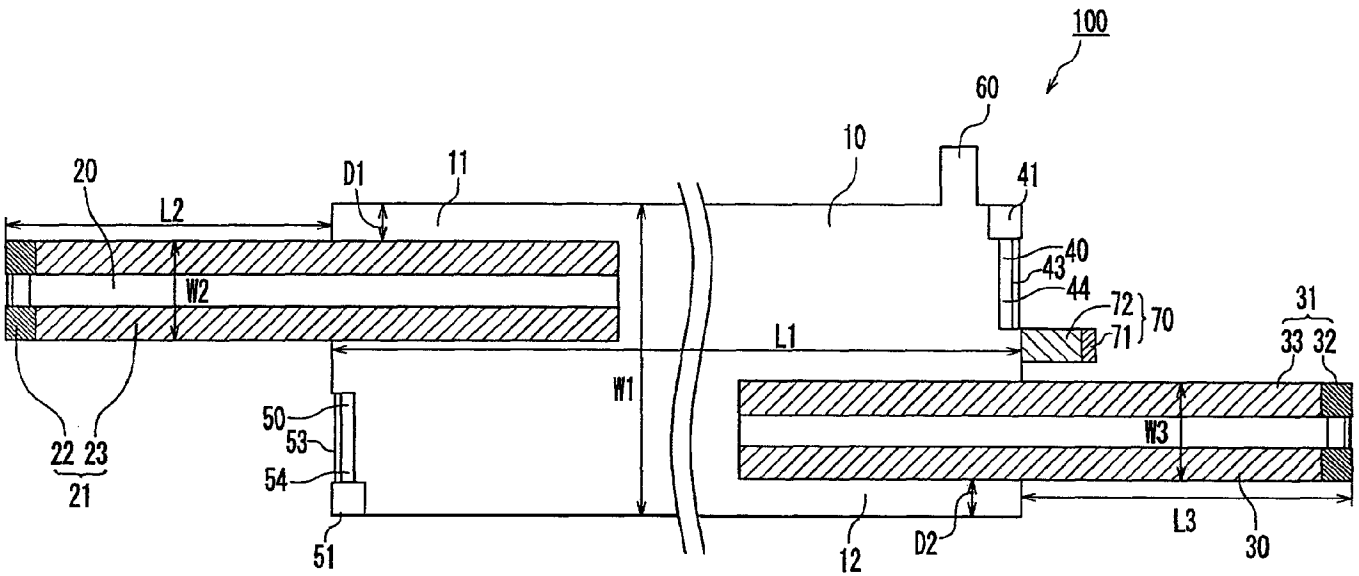
[FIG. 1A] A plan view illustrating a front surface of a load fixing device according to a preferred embodiment of the present invention.
Figure 1A:
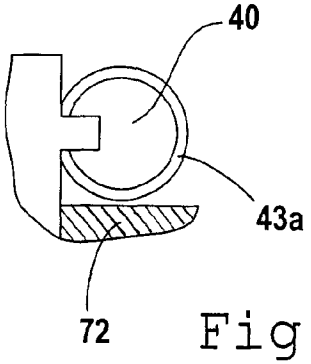
Figure 1A:
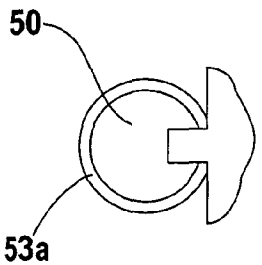

10 belt-like sheet
20 first fastening section
30 second fastening section
21, 31 engagement means
22, 32 hook-and-loop fastener
23, 33 hook-and-loop fastener
40 first-fastening-section passing section
50 second-fastening-section passing section
60 temporary stopper
100 load fixing device

BEST MODE FOR CARRYING OUT THE INVENTION

Figure 2:
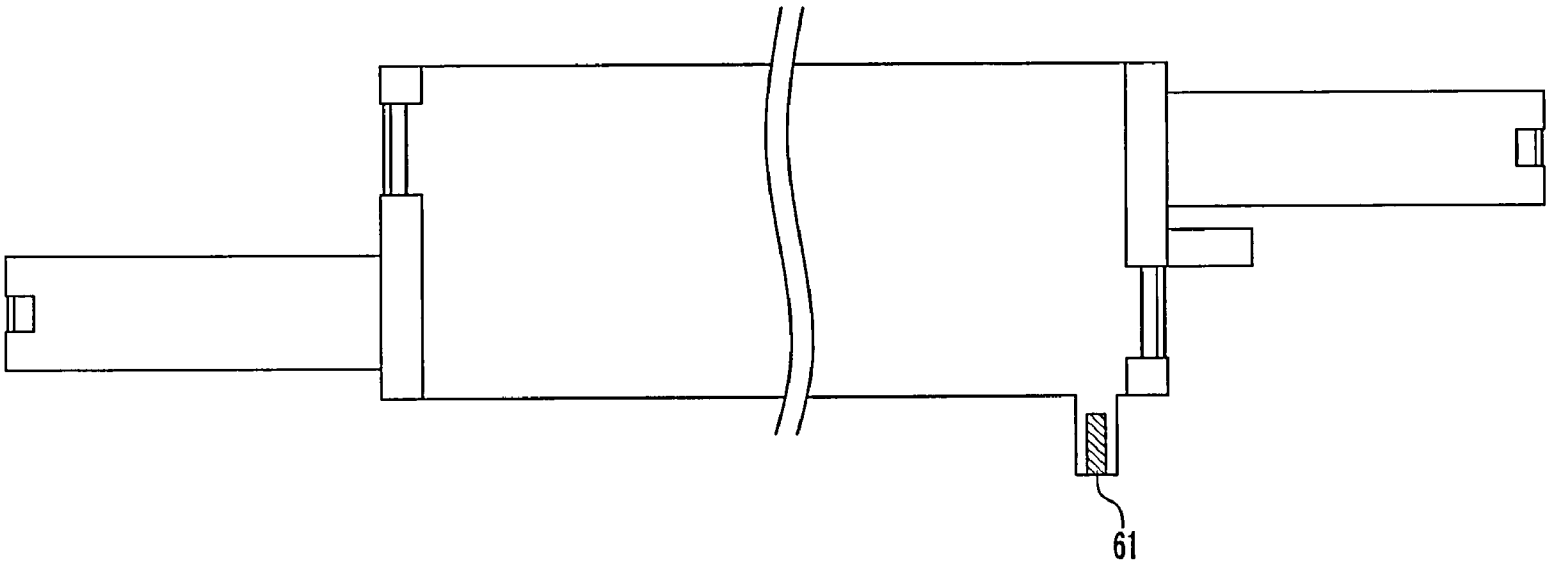
[FIG. 2] A plan view illustrating a back surface of the load fixing device of FIG. 1A.

FIG. 1A is a plan view illustrating a front surface of a load fixing device according to a preferred embodiment of the present invention. FIG. 2 is a plan view illustrating a back surface of the load fixing device of FIG. 1A. A load fixing device 100 has a belt-like sheet 10 wrapped around an outer periphery of burdens (hereinafter also referred to as load) stacked in multiple stages on a pallet or a carrier. The belt-like sheet 10 has a length appropriate to be wrapped around the outer periphery of the loads and to be bound. For example, when stacking the burdens on a pallet having one side of 110 cm, the length L1 of the belt-like sheet is preferably 400 cm to 440 cm. A very large binding force can be obtained with such length when wrapped around and fastened to the burdens. Further, the belt-like sheet 10 has a width appropriate to hold the multiply stacked burdens with one sheet. For example, the width W1 of the belt-like sheet is preferably 40 cm to 100 cm.

The belt-like sheet is made of any appropriate material. Specific examples of the material includes polyester (e.g., usual polyester, recycled polyethylene terephthalate (PET)), nylon, biodegradable resin (e.g., polylactic acid originating from corn), and the like. In one embodiment, an entire of the belt-like sheet is made of thick recycled PET sheet. According to such a configuration, static electricity is less likely to occur, adverse affect on the loads is small, and durability is excellent. For instance, the load fixing device using such belt-like sheet can be reused for 1000 or more times. In addition, such a configuration is preferable in terms of environmental problems, and also accords with the concept of the load fixing device of the present invention. The content of recycled PET in the recycled PET sheet is preferably 70% by weight to 100% by weight, more preferably 90% by weight to 100% by weight, and most preferably substantially 100% by weight. Higher recyclability is obtained the closer the content of the recycled PET is to 100% by weight. As a result, a load fixing device more kind to the environment is obtained. In one embodiment, the back surface of the belt-like sheet 10 is made of cotton cloth. The generation of static electricity can be further suppressed with such a configuration.

The belt-like sheet 10 may be formed by one sheet, or a portion made of elastic material may be interposed at an intermediate portion of the sheet. The workability of wrapping the belt-like sheet 10 around the load is more facilitated by the latter configuration. The portion made of elastic material is made of, for example, fabric interweaved with polyurethane elastic yarn. In another embodiment, the belt-like sheet 10 may be entirely made of elastic material or stretchable material. According to such a configuration, the loads can be tightly bound and satisfactorily fixed even if the burdens having different shapes are stacked on the pallet etc. and projected and depressed portions are formed at the side surface of the loads. In such embodiment, the belt-like sheet 10 is made of mesh fabric or net fabric of stretchable fiber.

Further, the belt-like sheet may be provided, as needed, with a pocket for attaching a tag so that the content of the load can be checked. The configuration enabling the content of the load to be checked includes configuring at least part of the belt-like sheet with transparent material or mesh fabric or net fabric, and providing an opening that acts as a check window at part of the belt-like sheet.

Figure 1B:
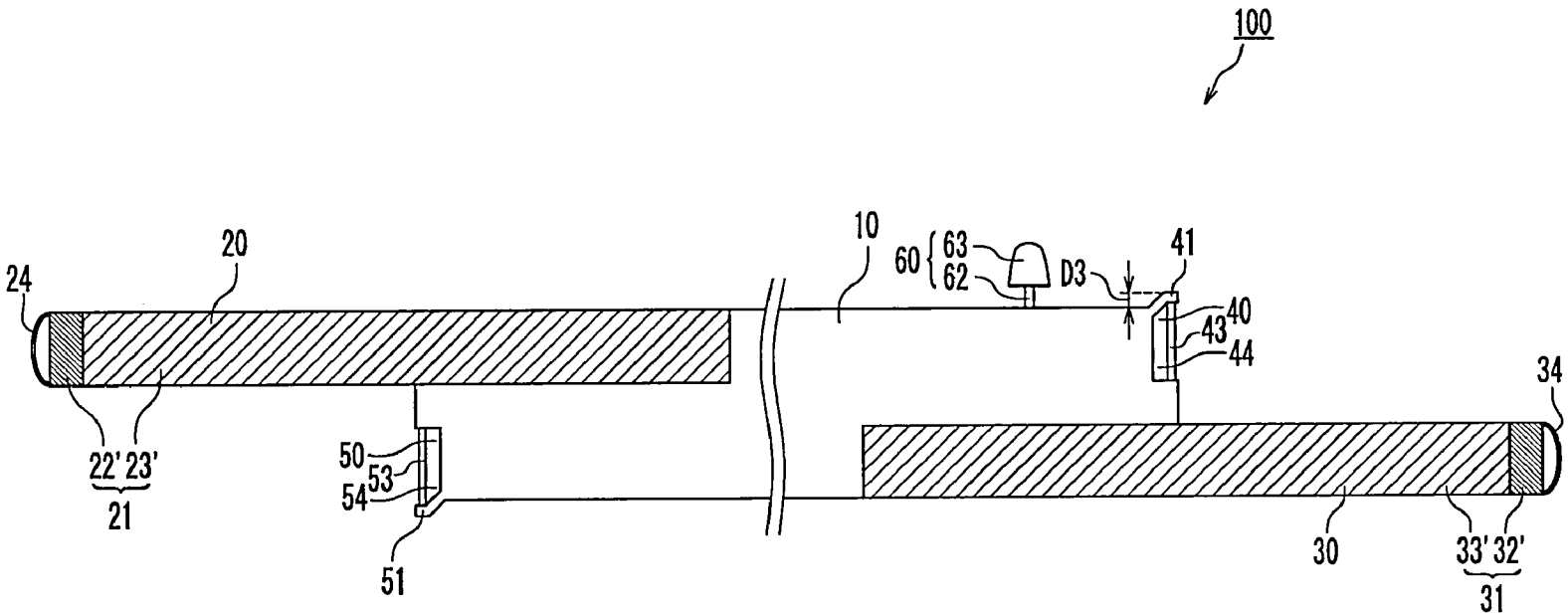
[FIG. 1B] A plan view illustrating a front surface of a load fixing device according to another preferred embodiment of the present invention.
Figure 1C:
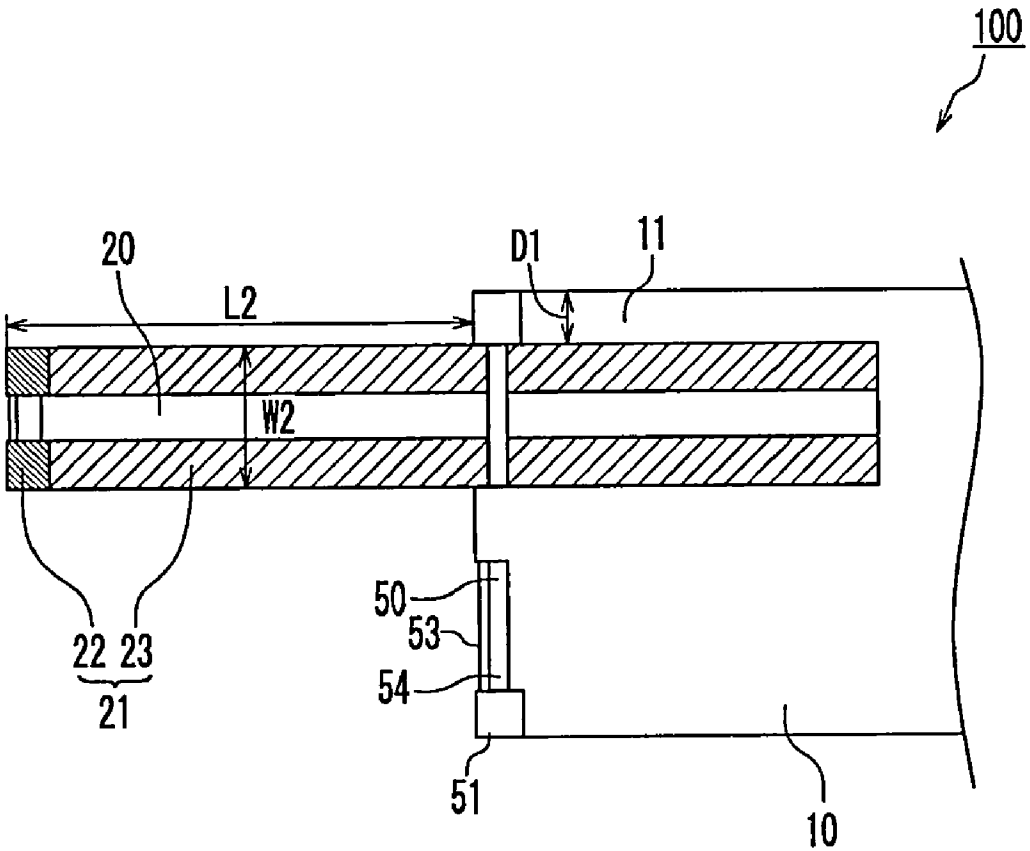
[FIG. 1C] A plan view of main parts illustrating a front surface of a load fixing device according to still another preferred embodiment of the present invention.
Figure 1D:
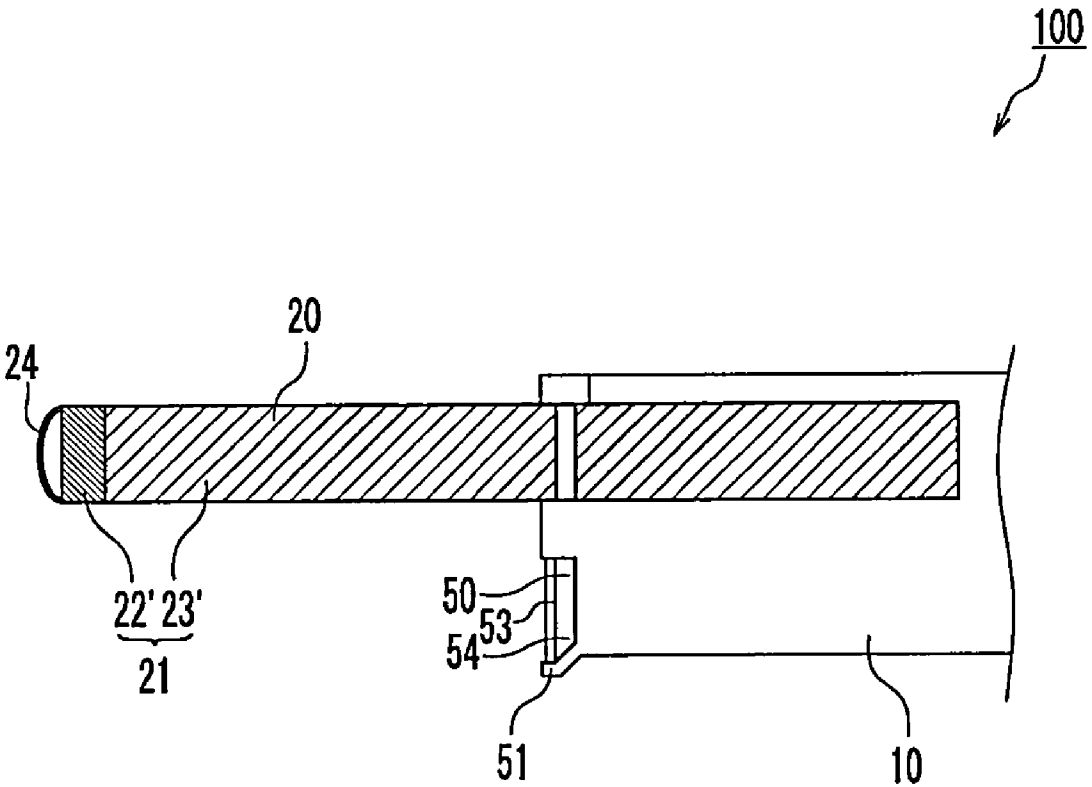
[FIG. 1D] A plan view of main parts illustrating a front surface of a load fixing device according to still another preferred embodiment of the present invention.

The load fixing device 100 of the present invention includes a first fastening section 20 and a second fastening section 30 provided at opposing corners of the belt-like sheet 10. More specifically, the first fastening section 20 is provided at an upper part in the width direction of a first end 11 of the belt-like sheet, and the second fastening section 30 is provided at a lower part in the width direction of a second end 12 of the belt-like sheet. In one embodiment, the first fastening section 20 is provided such that the upper end is at a position of a predetermined distance D1 from the upper end in the width direction of the belt-like sheet, and the second fastening section 30 is provided such that the lower end is at a position of a predetermined distance D2 from the lower end in the width direction of the belt-like sheet. The predetermined distances D1 and D2 are preferably smaller than or equal to 20%, more preferably smaller than or equal to 15%, particularly preferably smaller than or equal to 10%, and most preferably between 5% and 10% of the width W1 of the belt-like sheet. According to such a configuration, the upper and lower ends of the belt-like sheet do not loosen in binding and even binding can be realized. More preferably, D1 and D2 are equal. In another embodiment, as illustrated in FIG. 1B, the first fastening section 20 is provided at the upper end in the width direction of the first end 11 of the belt-like sheet, and the second fastening section 30 is provided at the lower end in the width direction of the second end 12 of the belt-like sheet (i.e., D1 and D2 are both zero). The loosening in time of binding is more significantly prevented by adopting such mode. The first fastening section 20 and the second fastening section 30 may be configured extending from the belt-like sheet as illustrated in FIG. 1A and FIG. 1B, or may be formed as separate members removable to the belt-like sheet as illustrated in FIG. 1C and FIG. 1D. When the first fastening section 20 and the second fastening section 30 are removable separate members, the sewing in time of manufacturing is facilitated, the variation in quality among the products is prevented, and the cost can be saved. As means for removably attaching the first fastening section 20 and the second fastening section 30, any appropriate means can be adopted. Specific examples include hook, button, and snap.

The first fastening section 20 and the second fastening section 30 respectively have an engagement means 21, 31. In one embodiment, the engagement means 21(31) includes hook-and-loop fasteners 22(32) and 23(33) that can engage to each other. In the illustrated example, the hook-and-loop fastener (male) 22(32) is provided at the most distal end of the fastening section, and the hook-and-loop fastener (female) 23(33) is provided towards the belt-like sheet 10 from the most distal end. The hook-and-loop fastener is preferably made by interweaving conductive fiber. According to such a configuration, the generation of static electricity when detaching the load fixing device from the burdens can be suppressed, and hence adverse affect on the stacked burdens can be reduced. In the embodiment of FIG. 1A, the engagement means 21(31) is provided at both ends in the width direction of the fastening section 20(30). In another embodiment, as illustrated in FIG. 1B, the engagement means 21(31) is provided over substantially the entire width direction of the fastening section 20(30). In the illustrated example, a mode of using the hook-and-loop fastener for the engagement means 21 and 31 is described, but the engagement means may be a hook, a button, a snap, and the like. For instance, the belt-like sheet 10 may be made of net fabric, and the hook may be locked to the mesh of the net. Further, the engagement means may combine and use the respective modes (e.g., hook-and-loop fastener and hook).

In one embodiment, the width W2 of the first fastening section and the width W3 of the second fastening section are the same. According to such a configuration, the burdens can be fastened with a very strong binding force because the binding force is evenly exerted to the upper half and the lower half of the belt-like sheet. Further, as the binding force is exerted in opposite directions at the upper half and the lower half of the belt-like sheet, excellent stability is obtained even if the burdens swing during transportation, and the possibility of collapse of the burdens is greatly reduced. In addition, the burdens can be successfully fixed even by workers having a relatively weak strength such as women and elderly. In one embodiment, the width W2 of the first fastening section and the width W3 of the second fastening section are respectively 10% to 35%, and more preferably 20% to 25% of the width W1 of the belt-like sheet. Stronger binding force can be obtained if W2/W1 (and W3/W1) is at such ratio. A relay section (not shown) extending in a tapered shape from the belt-like sheet and continuing to the fastening section may be provided between the fastening section and the belt-like sheet, as needed. The traction force when fastening the burdens is very satisfactorily transmitted to the belt-like sheet by providing the relay section, whereby an excellent binding force can be obtained.

Length L2 of the first fastening section and length L3 of the second fastening section are appropriately set according to the pallet size, the length L1 of the belt-like sheet, and the like. For example, when stacking the burdens on a pallet having one side of 110 cm, the length L2 of the first fastening section and the length L3 of the second fastening section are preferably 30 cm to 200 cm, and more preferably 30 cm to 80 cm, with L2 and L3 being the same. According to such lengths, an excellent binding force is obtained when wrapped around the burdens and fastened. Further, even binding force can be exerted in opposite directions to the upper half and the lower half of the belt-like sheet by having L2 and L3 the same, and thus excellent fastening stability of the burdens can be obtained.

In one embodiment, as illustrated in FIG. 1A, the most distal ends (portions where the hook-and-loop fasteners 22 and 32 are provided) of the first and second fastening sections are respectively formed as two fold-back portions, where a glass fiber rod is internally held in the fold-back portion. According to such a configuration, the workability in fastening improves because pulling loops are formed at the distal end portions of the first and second fastening sections. In another embodiment, as illustrated in FIG. 1B, a grip section 24(34) may be formed using a non-stretchable, flexible belt (e.g., PP multi-belt) at the most distal end portions of the fastening sections. According to such embodiment, the force can be easily applied in performing binding by pulling the fastening sections, and thus the workability further improves, and loosening in time of binding can be prevented. In the embodiment of FIG. 1B, the glass fiber rod is internally held over the entire width direction of the most distal end portions of the fastening sections, and the fastening sections can be easily pulled.

The load fixing device 100 of the present invention has a first-fastening-section passing section 40 and a second-fastening-section passing section 50 provided at opposing corners of the belt-like sheet 10 in correspondence to the first fastening section 20 and the second fastening section 30 provided at the opposing corners of the belt-like sheet 10. More specifically, the first-fastening-section passing section 40 is provided at the upper part in the width direction of the second end 12 of the belt-like sheet, and the second-fastening-section passing section 50 is provided at the lower part in the width direction of the first end 11 of the belt-like sheet. The first-fastening-section passing section 40 has a fold-back portion 41 provided at the upper end in the width direction at the second end 12 of the belt-like sheet 10, where one end of a glass fiber rod 43 having substantially the same length as the width of the belt-like sheet is internally held in the fold-back portion, and about half of the rod 43 is internally held in the fold-back portion provided from the lower end to the central part in the width direction at the end in the longitudinal direction of the belt-like sheet. Therefore, a through-hole 44 is defined between the end of the belt-like sheet and the glass fiber rod. Similarly, the second-fastening-section passing section 50 is provided with a fold-back portion 51 at the lower end in the width direction at the first end 11 of the belt-like sheet 10, where one end of a glass fiber rod 53 having substantially the same length as the width of the belt-like sheet is internally held in the fold-back portion, and about half of the rod 53 is internally held in the fold-back portion provided from the upper end to the central part in the width direction at the end in the longitudinal direction of the belt-like sheet. Therefore, a through-hole 54 is defined between the end of the belt-like sheet and the glass fiber rod. Note that the fold-back portion may be provided at the upper end (lower end) and the central part in the width direction, respectively, using the rod 43(53) of a length of about half of the belt-like sheet, and the rod 43(53) may be internally held in the two fold-back portions. Further, the fold-back portion for internally holding the rod 43(53) may be formed by folding back the end of the belt-like sheet itself or by attaching (e.g., sewing) a separate member (e.g., cloth sewed by folding back) provided with a hole for passing the rod to the end of the belt-like sheet. In still another embodiment, one sheet of cloth may be sewed to one surface at the end of the belt-like sheet, and a hole for passing the rod may be formed. The fold-back portions 41 and 51 may be reinforced with any appropriate means, as needed. For instance, the play of the fold-back portion reduces and the friction with the rod 43(53) reduces through reinforcement of the inner side of the fold-back portion by sewing a filler cloth, PP multi-belt, and the like, and thus ragging and ripping of the fold-back portion as well as jumping out of the rod 43(53) can be satisfactorily prevented. Further, for instance, by reinforcing the outer side of the fold-back portion, the rod 43(53) can be appropriately internally held even if the fold-back portion is provided projecting in the width direction of the belt-like sheet as hereinafter described.

In any of the embodiments described above, the glass fiber rod at the distal end portion of the fastening section and the fastening-section passing section may be removable. According to such a configuration, fractional recovery is facilitated, and recycling of the each member of the load fixing device is promoted. Further, the belt-like sheet can be easily cleaned. For example, the glass fiber rod can be removable by configuring the fold-back portion for internally holding the glass fiber rod with the hook-and-loop fastener. In any of the embodiments described above, any appropriate location of the belt-like sheet may be reinforced with any appropriate means, as necessary. For instance, ragging and ripping of the relevant location, and jumping out of the rod can be more satisfactory prevented by reinforcing, other than the fold-back portions 41 and 51, at least one location of the portion related to inclusive holding of the glass fiber rod at the distal end portion of the fastening section and the fastening-section passing section. The reinforcing location includes the fold-back portion at the distal end portion of the fastening section, both ends of the fold-back portion provided from the lower end towards the central part in the width direction at the end in the longitudinal direction of the belt-like sheet for holding the rod 43 with the fold-back portion 41, both ends of the fold-back portion provided from the upper end towards the central part in the width direction at the end in the longitudinal direction of the belt-like sheet for holding the rod 53 with the fold-back portion 51. Specific examples of the reinforcing means include, similarly to the above, sewing of filler cloth, PP multi-belt, and the like.

In still another embodiment, the fold-back portions 41 and 51 are provided projecting in the width direction of the belt-like sheet, as illustrated in FIG. 1B. Through adoption of such a configuration, the size in the width direction of the fold-back portion can be ensured even if the fastening sections 20 and 30 are provided at the ends in the width direction of the belt-like sheet as described above (i.e., even if D1 and D2 are zero), whereby the rod 43(53) can be satisfactorily internally held. For instance, the projecting length D3 of the fold-back portions 41 and 51 is preferably smaller than or equal to 10%, more preferably 5% to 10%, and most preferably about 5% of the length W1 in the width direction of the belt-like sheet. As illustrated in FIG. 1B, the fold-back portions 41 and 51 preferably have the side at the end of the width direction and not holding the rod 43(53) which is projecting in a tapered form.

Further, in the embodiment where the belt-like sheet 10 is made of mesh fabric or net fabric of stretchable fiber, the pulling loop portion at the most distal end portion of the fastening section and the fastening-section passing section may not be provided. For instance, a string-form hook-and-loop fastener may be sewed to the belt-like sheet, and such hook-and-loop fastener may be inserted to the mesh of the belt-like sheet in binding to perform fastening.

FIGS. 1A and 2 illustrate an embodiment in which one sheet of cloth is sewed to the back surface at the end of the belt-like sheet. The belt-like sheet is wrapped around the outer periphery of the burdens and the first fastening section 20 is passed through the through-hole 44, and thereafter, folded back and fastened, and the hook-and-loop fasteners 22 and 23 are engaged to thereby bind the burdens at the upper part of the belt-like sheet. The second fastening section 30 is passed through the through-hole 54 in this state, and thereafter, folded back and fastened, and the hook-and-loop fasteners 32 and 33 are engaged to thereby bind the burdens at the lower part of the belt-like sheet. Consequently, the burdens are bound with the entire belt-like sheet. The binding force is exerted in opposite directions to the upper half and the lower half of the belt-like sheet by fixing the burdens in such a manner, and thus provides excellent stability and greatly reduces the possibility of collapse of burdens even if the burdens swing in transportation. The rods 43 and 53 may be made of aluminum, stainless steel, or carbon fiber. As illustrated at FIGS. 1Aa and 1Ab, respectively, the first-fastening-section passing section 40 and the second-fastening-section passing section 50 may be formed as a ring member 43*a* and 53*a* (e.g., through ring such as a buckle of a usual belt) removable to the belt-like sheet.

The load fixing device 100 preferably includes a temporary stopper 60. In one embodiment, the temporary stopper 60 is provided to extend in the width direction from the belt-like sheet 10, as illustrated in FIG. 1A. The temporary stopper 60 is provided at any appropriate position in the longitudinal direction of the belt-like sheet. For instance, the temporary stopper 60 may be provided to extend from both the upper end and the lower end in the width direction of the belt-like sheet, or may be provided to extend only from the upper end. In view of workability, the temporary stopper 60 merely needs to be provided to extend only from the upper end in the width direction of the belt-like sheet. According to such a configuration, the upper part of the belt-like sheet can be wrapped around while being held at an appropriate position by inserting the temporary stopper between the loads. Therefore, the work in which one person wraps the sheet around the load while another person holds the upper part of the belt-like sheet is avoided. In other words, the work can be carried out by one person, and the workability can be greatly improved.

Figure 5:
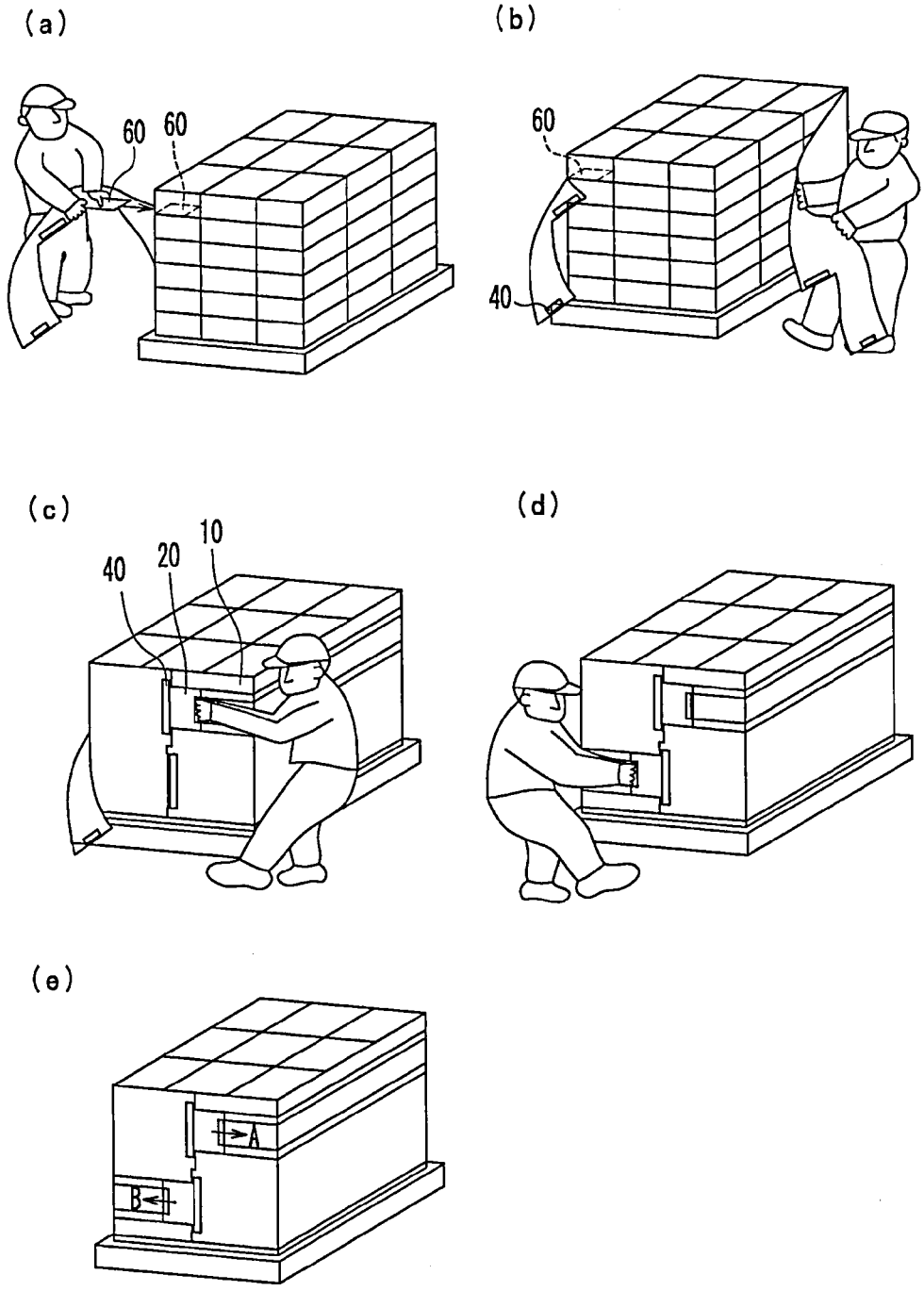
[FIG. 5] Portions (a) to (e) are schematic views describing working procedures when binding burdens using the load fixing device of the present invention.

The temporary stopper 60 is preferably provided at a position of 15% to 85% of the length of one side of the load (substantially length of one side of pallet or carrier) from the end on the side of the first-fastening-section passing section 40 of the belt-like sheet 10. More preferably, the temporary stopper 60 is provided at a position of 35% to 65%. According to such a configuration, the upper part of the belt-like sheet can be temporarily held by inserting the temporary stopper between the loads at the end of the pallet. Thus, the workability is very satisfactory, and the first-fastening-section passing section 40 (through-hole 44) is automatically positioned at the central part of one side of the pallet and the like by wrapping the belt-like sheet around the outer periphery of the burden. The second-fastening-section passing section 50 (through-hole 54) is also automatically positioned at the central part of one side of the pallet and the like by passing the first fastening section 20 through the through hole 44 and fastening the same in this state. Therefore, there is no need to adjust the position while wrapping the sheet, or to re-wrap the sheet when the fastening position shifts to the corner of the pallet and the like. As a result, the workability of wrapping can be further greatly improved. If the fastening-section passing section is positioned at the corner of the load, the adjacent load sometimes gets scratched or the loads sometimes get caught to each other. However, such drawbacks can be avoided by providing the temporary stopper because the fastening-section passing section is prevented from being positioned at the corner of the load. In this specification, "between the loads at the end of the pallet" refers to between the burdens positioned at the four corners in an aggregate of stacked burdens, as illustrated in FIGS. 5(*a*) and 5(*b*). Therefore, "end of pallet" includes the vicinity of the end of the pallet when the loads are stacked protruding from the pallet and/or stacked with an extra space in the pallet.

The temporary stopper is preferably made of a material that is less likely to slide or is subjected to slip resistance processing. A specific example of such a material includes a non-woven cloth of styrene-based elastomer. A specific example of the slip resistance processing includes attaching a rubber sheet 61 to the temporary stopper. In the illustrated example, the rubber sheet 61 is attached along the extending direction to the central part of the temporary sheet, but may be attached to the distal end of the temporary stopper.

As illustrated in FIG. 1B, in another embodiment, the temporary stopper 60 includes a coupling portion 62 to be coupled to the belt-like sheet and a plate-shaped portion 63 removably attached to the coupling portion. The coupling portion 62 may extend from the belt-like sheet or may be removably attached to the belt-like sheet as a separate member. When the coupling portion is configured as a separate member, the material is not particularly limited. For instance, the PP multi-belt may be adopted. The width and the length of the coupling portion are appropriately set depending on the purpose. Any appropriate material and shape can be adopted for the plate-shaped portion 63 as long as it has properties of being easily inserted between the loads and less likely to slide. A typical material for the plate-shaped portion includes polycarbonate, polypropylene, biodegradable plastic, wood, and metal. Polycarbonate is preferable. Polycarbonate has advantages of being easily molded to the desired shape, having an appropriate hardness and flexibility to be inserted between the loads, not generating static electricity, and being inexpensive. A typical shape of the plate-shaped portion includes scoop shape, spatula shape, and the like, as illustrated in FIG. 1B. The thickness of the plate-shaped portion can be appropriately set depending on the purpose. The thickness of the plate-shaped portion is, for example, 0.3 mm to 1.0 mm. Any appropriate means can be adopted for the means for removably attaching the coupling portion 62 and the plate-shaped portion 63. A specific example includes a hook, a button, a snap, and the like.

The load fixing device 100 further includes an accommodation binding member 70, as needed. The accommodation binding member 70 is provided at any appropriate position. In one embodiment, the accommodation binding member 70 is attached to the fold-back portion 41 of the first-fastening-section passing section 40. The accommodation binding member 70 is configured by, for example, a hook-and-loop fastener (male) 71 and a hook-and-loop fastener (female) 72. According to such a configuration, when recovering after use, the load fixing device can be bound in a rolled-up state, and thus the load fixing device can be conveyed and recovered in a compact state.

Figure 3:
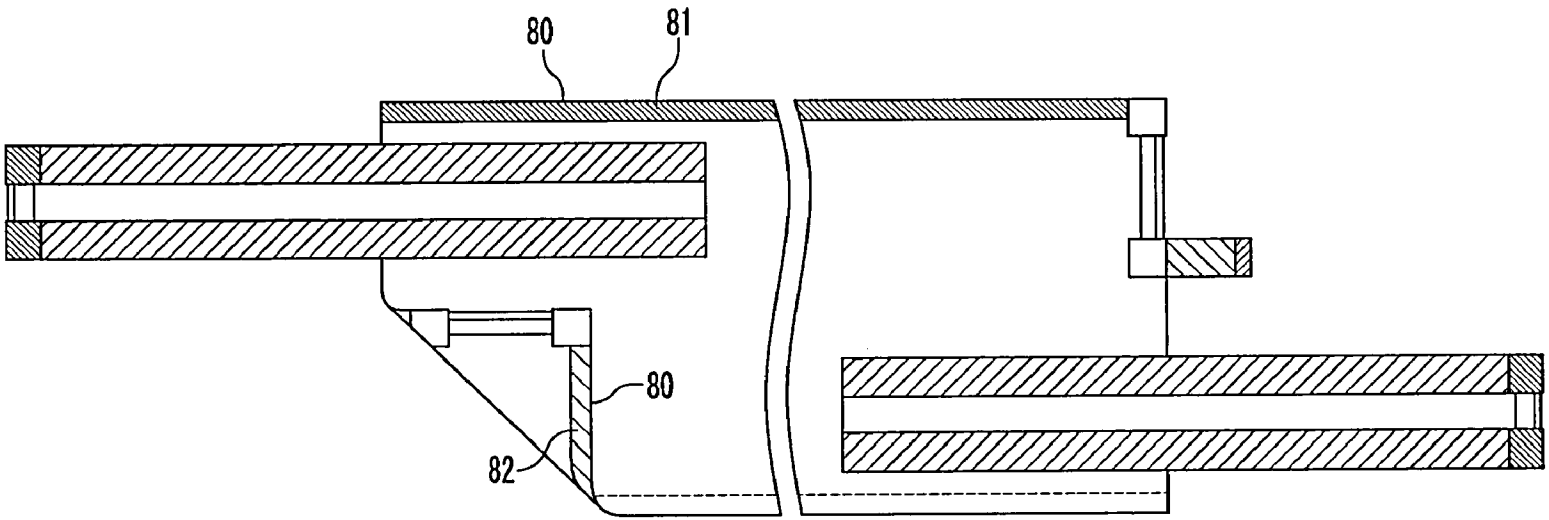
[FIG. 3] A plan view illustrating a front surface of a load fixing device according to another embodiment of the present invention.

As illustrated in FIG. 3, in one embodiment, the load fixing device 100 includes a mutual attachment section 80. The mutual attachment section 80, for example, is configured by a hook-and-loop fastener (male) 81 provided at the upper end in the width direction of the front surface of the belt-like sheet, and a hook-and-loop fastener (female) 82 provided at the lower end in the width direction of the back surface of the belt-like sheet. According to such a configuration, multiple load fixing devices can be fixed to each other, and thus it is possible to respond to a case where the number of burden stacking levels is large. In the illustrated example, the hook-and-loop fastener (male) is provided at the upper end in the width direction of the front surface of the belt-like sheet, and the hook-and-loop fastener (female) is provided at the lower end in the width direction of the back surface of the belt-like sheet. However, the positions where the hook-and-loop fasteners (male) and (female) are provided are not limited as long as multiple belt-like sheets can be fixed to each other.

Figure 4:
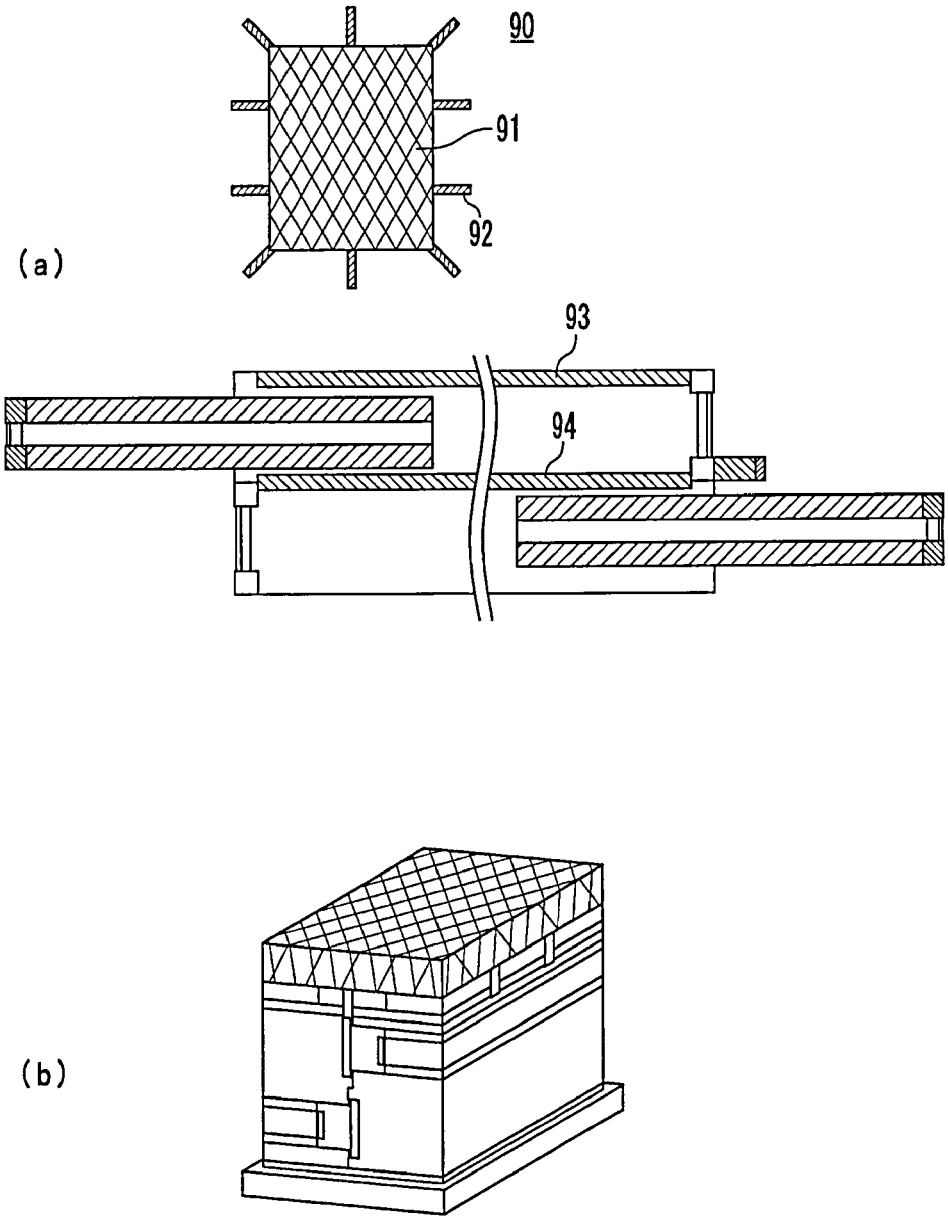
[FIG. 4] Portion (a) is a plan view illustrating a front surface of a load fixing device according to still another embodiment of the present invention, and portion (b) is a schematic view illustrating a fixed state of loads by the load fixing device.

As illustrated in FIG. 4(*a*), in one embodiment, the load fixing device 100 further includes an upper fixing member 90 to be engaged to the belt-like sheet 10. The upper fixing member 90 typically includes an upper fixing section 91 and an engagement section 92. The upper fixing section 91 is typically formed of an elastic net. Through the use of the elastic net, the collapse of burdens can be satisfactorily prevented irrespective of the height, shape, dimension, and the like of the burden. The engagement section 92 is typically configured by multiple hook-and-loop fasteners (male) attached towards the outer side from the upper fixing section 91. In this embodiment, fixing member engagement sections (typically, hook-and-loop fasteners (female)) 93 and 94 are provided along the longitudinal direction at the upper end and the central part of the belt-like sheet. The attachment position of the upper fixing member can be adjusted according to the height and the shape of the burden by providing two engagement sections. The fixed state of the loads by the load fixing device of this embodiment is illustrated in FIG. 4(*b*).

A method of using the load fixing device of the present invention is described with reference to FIGS. 5(*a*) to 5(*e*). First, as illustrated in FIG. 5(*a*), the temporary stopper 60 is inserted between the loads at the end of the pallet. Then, as illustrated in FIG. 5(*b*), the belt-like sheet 10 is wrapped around the loads while maintaining the position of the temporary stopper (normally, the temporary stopper is maintained at the initial position without performing a special operation). Thereafter, as illustrated in FIG. 5(*c*), the first fastening section 20 is passed through the through-hole 44 of the first-fastening-section passing section 40, and folded back to fasten the loads. Here, according to the present invention, the first-fastening-section passing section 40 is automatically positioned at the central part of one side of the pallet by positioning the temporary stopper 60 at the end of the pallet. Therefore, there is no need to adjust the position while wrapping the sheet, or to re-wrap the sheet when the fastening position shifts to the corner of the pallet. The loads are bound by the upper half of the belt-like sheet by engaging the hook-and-loop fasteners 22 and 23 in this state. Thereafter, as illustrated in FIG. 5(*d*), in the above-mentioned state, the second fastening section 30 is passed through the through-hole 54 of the second-fastening-section passing section 50, and folded back to fasten the loads, and the hook-and-loop fasteners 32 and 33 are engaged with each other. As a result, as illustrated in FIG. 5(*e*), the binding force in the direction of the arrow A is exerted at the upper half of the belt-like sheet, and the binding force in the direction of the arrow B is exerted at the lower half of the belt-like sheet. Therefore, excellent stability is obtained, and the probability of collapse of burdens is greatly reduced even if the burdens swing in time of transportation.

It should be recognized that the illustrated embodiments may be appropriately combined in the present invention.

INDUSTRIAL APPLICABILITY

The load fixing device of the present invention is suitably used to prevent collapse of burdens stacked in multiple stages on the pallet or the carrier. Further, because the load fixing device of the present invention can be reused, discarding and burning are not necessary unlike the stretch film. Therefore, it is also effective for environment conservation such as emission reduction and the like of global warming gas.

The invention claimed is:

1. A load fixing device, comprising:

a belt-shape sheet having a predetermined length to be wounded around an outer periphery of loads;

a first fastening section provided at an upper part in a width direction of a first end of the belt-shape sheet and having an engagement means;

a first-fastening-section passing section provided at the upper part in the width direction of a second end of the belt-shape sheet, the first-fastening-section passing section configured to pass the first fastening section therethrough;

a second fastening section provided at a lower part in the width direction of the second end of the belt-shape sheet and having an engagement means; and a second-fastening-section passing section provided at the lower part in the width direction of the first end of the belt-shape sheet, the second-fastening-section passing section configured to pass the second fastening section therethrough.

2. A load fixing device according to claim 1, wherein the belt-shape sheet is made of recycled polyethylene terephthalate fiber.

3. A load fixing device according to claim 1, wherein the engagement means are respectively at least one selected from a hook-and-loop fastener, a hook, a button, and a snap.

4. A load fixing device according to claim 1, further comprising an upper fixing member to be engaged to the belt-shape sheet.

5. A load fixing device according to claim 1, wherein the first fastening section and the second fastening section are respectively removable with respect to the belt-shape sheet.

6. A load fixing device according to claim 1, wherein the first-fastening-section passing section and the second-fastening-section passing section are respectively a through-hole defined by the end of the belt-shape sheet and a rod internally held at the end, or a ring member removable with respect to the belt-shape sheet.

7. A load fixing device according to claim 6, wherein the rod internally held at the end is removable.

8. A load fixing device according to claim 1, further comprising a temporary stopper provided at a predetermined position in a longitudinal direction of the belt-shape sheet.

9. A load fixing device according to claim 1, further comprising an accommodation binding member.

* * * * *